United States Patent [19]

Chou

[11] Patent Number: 4,758,266

[45] **Date of Patent: * Jul. 19, 1988**

[54] PRODUCTION OF HIGH SURFACE AREA NICKEL POWDER

[75] Inventor: Eddie C. J. Chou, Arvada, Colo.

[73] Assignee: Amax Inc., Greenwich, Conn.

[ * ] Notice: The portion of the term of this patent subsequent to Oct. 8, 2002 has been disclaimed.

[21] Appl. No.: 895,549

[22] Filed: Aug. 11, 1986

[51] Int. Cl.[4] ..... C22B 23/00

[52] U.S. Cl. ..... 75/0.5 AA; 75/109; 75/119

[58] Field of Search ..... 75/0.5 R, 0.5 AA, 0.5 A, 75/251, 119, 108, 109

[56] References Cited

U.S. PATENT DOCUMENTS

| | | | |
|---|---|---|---|
| 3,669,643 | 6/1972 | Bagley et al. | 75/108 |
| 3,775,098 | 11/1973 | Kunda | 75/108 |
| 4,096,316 | 6/1978 | Tamai et al. | 75/0.5 AA |
| 4,545,814 | 10/1985 | Chou et al. | 75/0.5 AA |

FOREIGN PATENT DOCUMENTS

| | | | |
|---|---|---|---|
| 1084887 | 9/1967 | Canada | 75/0.5 AA |
| 352959 | 10/1972 | U.S.S.R. | 75/0.5 AA |

*Primary Examiner*—Christopher W. Brody

*Attorney, Agent, or Firm*—Michael A. Ciomek; Eugene J. Kalil

[57] ABSTRACT

Nickel powder of high surface area is produced by pressurized hydrogen reduction of an ammoniacal aqueous nickel sulfate solution using a small amount of a catalytic reductant compound exemplified by formaldehyde sulfoxalate (rongalite).

3 Claims, 2 Drawing Sheets

SECONDARY ELECTRON MICROSCOPY OF NICKEL POWDER FROM TEST 6 AT 900X

SECONDARY ELECTRON MICROSCOPY OF INCO NICKEL POWDER 255 AT 900X

PRODUCTION OF HIGH SURFACE AREA NICKEL POWDER

The present invention is directed to a hydrometallugical method for producing fine nickel powder having low apparent density and extended surface area, thereby contributing the potential for utility in applications such as the production of battery active mass and other fields in which hydrometallurgically produced nickel powders have heretofore been regarded as being unsuitable.

BACKGROUND OF THE INVENTION AND THE PRIOR ART

The production of nickel, cobalt and other metal powders by pressurized hydrogen reduction of aqueous ammoniacal sulfate solutions is a commercial practice pioneered by Sherritt Gordon Mines in Canada. In the process, it has been found that reduction kinetics are improved by the presence of particulate seed material such as fine nickel or cobalt powder. Such powders may come from many sources and may be introduced into the autoclave to act as nuclei for powder formation. U.S. Pat. No. 2,796,343 mentions the production of fine metal particles for use as seed by operations such as grinding of larger particles; precipitation by such reducing agents as hypophosphite, hydrazine and the like which are stronger than hydrogen, decomposition of nickel carbonyl and the limited reduction of acidic solutions. U.S. Pat. Nos. 2,734,821, 2,796,342 and 2,796,343 describe "self-nucleating" solutions in which agents such as stannous, cerous, manganous, ferrous, titanous, vanadous and chromous salts are added.

Known cobalt and nickel powders produced by the hydrogen reduction method are usually coarse, spherical powders since the usual practice is to repeatedly precipitate further metal upon the initially formed particles by further "densifications".

There are needs in the art for ultrafine powders.

Production of nickel, iron and cobalt powders by reduction of the metal ion or ions with reducing agents such as borohydrides, hypophosphates, borane, borazane, etc. is also known from patents such as U.S. Pat. Nos. 3,669,643 and 4,096,316. Such powders are said to be useful for magnetic applications.

The invention is directed to the production of fine nickel powder by hydrogen reduction at elevated pressure.

BRIEF SUMMARY OF THE INVENTION

The invention is directed to improvement in the production of nickel powder by hydrogen reduction at an elevated temperature and pressure from an aqueous sulfate solution containing nickel ions and ammonia wherein a small, catalytic amount of a compound from the group exemplified by formaldehyde sulfoxalate (rongalite) is employed to produce fine and fluffy nickel powder.

DETAILED DESCRIPTION OF THE INVENTION

Figure 3:
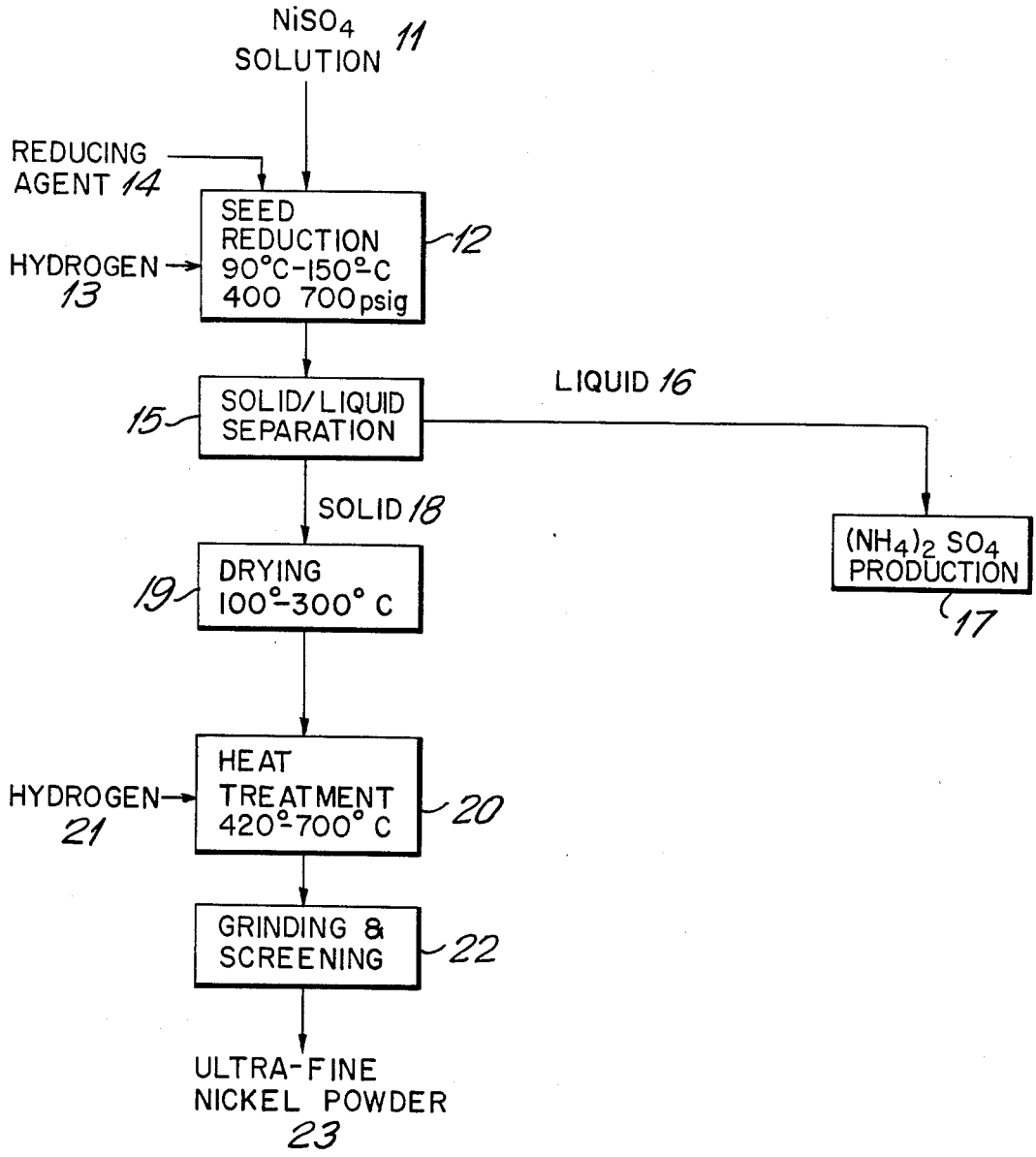
FIG. 3 is a flowsheet of the process embodying the invention.

The invention will first be described in reference to FIG. 3 of the drawing in which reference character 11 depicts the initial or starting aqueous sulfate solution which will generally contain at least about 30 grams per liter (gpl) to about 150 gpl of nickel. The solution is charged to the autoclave indicated at 12. Ammonia is added to the autoclave along with the feed nickel sulfate solution or during the reduction stage in an amount sufficient to neutralize the acid which is generated during reduction, as shown by the following reaction:

$$NiSO_4 + H_2 \rightarrow Ni^{\circ} + H_2SO_4$$

Initial conditions within the reactor (stirred autoclave) will be strongly ammoniacal. The reactor is pressurized with hydrogen 13 to about 400 to 700 psig and is operated at a temperature of about 90° to about 150° C. A small amount of a catalytic reducing agent 14 from the group consisting of sodium formaldehyde sulfoxalate (rongalite, $NaSO_2CH_2OH.2H_2O$), formaldehyde acetamide ($CH_3CONH.CH_2OH$), sodium formaldehyde bisulfide ($CH_2OH.NaSO_3 . H_2O$), formaldehyde hydrosulfide ($CH_2O.Na_2S_2O_4H_2O$), formaldehyde oxime ($H_2C{=}NOH$), etc., is introduced and the reduction reactions which produce nickel powder proceed under favorable kinetic conditions. Only a small amount of the catalytic reductant is required. As an example, as little as 0.3 grams of sodium formaldehyde sulfoxalate was effective to obtain over 99% reduction of nickel in a solution containing 102 gpl nickel in about 50 to 60 minutes at a hydrogen pressure of about 600 psig and a temperature of 150° to 155° C. In general, about 0.1% to about 0.5%, by weight, of reductant is used on the basis of dissolved nickel to be reduced. In molar percent, the reducing agent is used in the range of about 0.05% to about 0.25% of the nickel to be reduced. As little as 0.11 molar percent of formaldehyde sulfoxalate is effective. After reduction, solid-liquid separation 15 is accomplished with liquid 16 being rejected to ammonium sulfate production 17 and the produced nickel powder being dried at 19.

The reduction reaction is continued substantially to completion. The rate of reaction is dependent on many factors, including hydrogen pressure, temperature, concentration and identity of catalyst. It is desirable that the reduction be carried out as completely as possible and as rapidly as possible while assuring product quality.

The starting nickel sulfate solution should preferably be low in metal ions reducible by hydrogen. Thus, iron should not exceed 100 ppm, copper should not exceed 100 ppm, and cobalt should not exceed 100 ppm. Contaminants such as cadmium, boron, lead, chromium and calcium should not exceed a total of about 400 ppm.

The product nickel powder of high surface area is not pyrophoric, but usually contains more oxygen than other commercially available fine nickel powders. The oxygen content, as well as the sulfur content of the product nickel powder can be reduced by heat treatment in hydrogen at temperatures not exceeding about 600° C. for time up to about 4 hours. Such heat treatment tends to reduce the surface area and increase the bulk density of the powder. Heat treatment is indicated at 20 in the drawing using hydrogen 21. The product powder may be ground and screened as indicated at 22 in FIG. 3 to yield ultra fine nickel powder 23.

Examples will now be given.

EXAMPLE 1

Pressurized hydrogen reduction tests were conducted in a 2-liter stainless steel autoclave with 1.2-liter nickel sulfate solution containing 102 gpl Ni, 12 gpl $(NH_4)_2SO_4$, 100 ppm Ca, 94 ppm Na, 77 ppm Zn, 55 ppm Co, 50 ppm Mg, 23 ppm Si and other trace contaminants, such as Cd, B, Pb, Cr, Fe and Ca. In these tests, a small amount of sodium formaldehyde sulfoxalate (rongalite) was premixed with the feed solution prior to the hydrogen reduction at a total pressure of about 600 psig. Ammonium hydroxide (275 ml of concentrated ammonium hydroxide) was added to neutralize the acid generated during the reduction. Effects of the reduction temperature and the amount of rongalite addition on the reduction of nickel are presented in Table 1.

TABLE I

Pressurized Hydrogen Reduction of Nickel from a Nickel Sulfate Solution with Rongalite as the Seeding Reagent

| Test No. | Amount Added Grams | Temp. °C. | Reduction Time min. | % Reduced | Apparent Density g/cc | Grain Size, Micrometers | Surface Area $M^2/g$ | S % |
|---|---|---|---|---|---|---|---|---|
| 1 | 1 | 137 | 99 | 98.6 | 0.23 | 1 | 7.26 | 0.336 |
| 2 | 0.5 | 155 | 38 | 98.0 | 0.23 | 1 | — | 0.26 |
| 3 | 0.3 | 156 | 45 | 99.7 | 0.32 | 2 | — | 0.10 |
| 4 | 0.2 | 158 | 180 | incomplete | | | | |
| 5 | 0.2 | 177 | 300 | incomplete | | | | |
| 6 | 0.3 | 155 | 45 | 99 | 0.32 | 1 | 4.9 | 0.03 |
| 7 | 0.3 | 152 | 57 | 99.9 | 0.32 | 2 | 4.6 | 0.02 |
| 8 | 0.3 | 153 | 52 | 99.8 | 0.39 | 2 | 3.3 | 0.02 |
| 9 | 0.3 | 152 | 60 | 99.5 | 0.33 | 2 | 5.2 | 0.02 |

As shown in Table 1 approximately 0.3 grams of rongalite was required to reduce 1.2 liters of solution containing 102 gpl nickel. In the tests the feed solution was purged with inert gas (nitrogen or argon) and the seeding reagent solution was prepared just before addition. It was considered that some of the sulfur present in the product of Test No. 1 was due to entrainment of sulfate from the feed solution. Tests No. 6 through 9 were conducted using a smaller amount of rongalite (which contains 20.25 weight percent of sulfur) and with repulping of the filter cake of product nickel powder. The filter cake was rinsed with 400 ml of deionized water and the repulping involved slurrying the filter cake at 12% solids with deionized water at 70° C. for 20 minutes.

EXAMPLE 2

Products produced as described in Example 1 were measured for particle size, apparent density and surface area and compared to known nickel powders produced by the decomposition of nickel carbonyl with the results shown in Table 2.

TABLE 2

Physical Characteristics and Chemical Analysis of Known Nickel Powders and Nickel Powder from Rongalite Tests

| | INCO 123 | INCO 255 | INCO 287 | Product 1* | Product 2** |
|---|---|---|---|---|---|
| Average Particle Size, Micrometers | 3–7 | 2.2–2.8 | 2.6–3.3 | 1 | 1 |
| Apparent Density g/cc | 1.8–2.7 | 0.5–0.65 | 0.75–0.95 | 0.34 | 0.64 |
| Specific Surface Area, $M^2/g$ | — | 0.68 | 0.58 | 4.5 | 1.56 |
| Chemical Analyses, % | | | | | |
| C | 0.1 | 0.25 | 0.25 | .09 | 0.09 |
| S | 0.001 | 0.001 | 0.001 | 0.022 | 0.02 |
| O | 0.15 | 0.15 | 0.15 | 1.10 | 0.22 |
| Fe | 0.01 | 0.01 | 0.01 | 0.001 | 0.001 |

*Pressurized hydrogen reduction of nickel sulfate solution at 152° C. and 600 psig for about 1 hour.
**Hydrogen reduction of Product 1 at 550° C. for 1 hour.

The results of Table 2 demonstrate that non-pyrophoric nickel powders produced in accordance with the invention are finer, lighter and have a more extended surface area than known battery grade nickel powders.

EXAMPLE 3

Several of the nickel powders produced as described in Example 1 were subjected to treatment in hydrogen with the results set forth in Table 3.

TABLE 3

Effects of Heat Treatment on Sulfur Content in Nickel Powders Produced from Rongalite Tests

| Test No. | Temperature, °C. | Wt. Loss % | S % | Surface Area, $M_2/g$ | Apparent Density, g/cc |
|---|---|---|---|---|---|
| 2 | unwashed powder | | .15 | — | .23 |
| | 400 | 3 | .15 | — | .26 |
| | 500 | 3 | .07 | — | .33 |
| | 600 | 4 | .02 | — | 1.07 |
| 3 | 500 | 2 | .05 | — | .43 |
| | 550 | 2 | .02 | — | .64 |
| 6 | unwashed powder | | .05 | 4.9 | — |
| | 550 | 3 | .05 | 1.56 | — |
| 8 | washed powder | | .03 | 3.3 | — |
| | 550 | | .03 | 1.15 | — |

The results of Table 3 confirm that sulfur content of the powders can be reduced by hydrogen treatment at temperatures not exceeding about 600° C. with accompanying decrease in surface area and increase in density.

Figure 1:
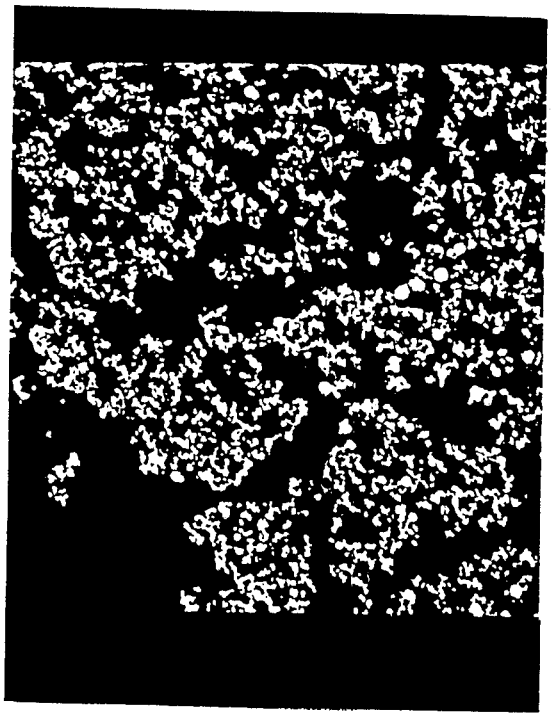
FIG. 1 is a drawing of a microstructure at about 900 diameters of a nickel powder product produced in accordance with the invention.
Figure 2:
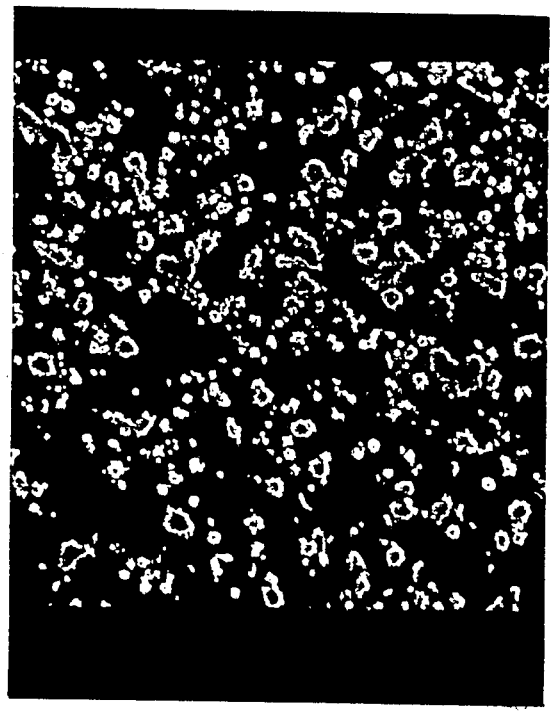
FIG. 2 is a drawing of a microstructure at about 900 diameters of a prior art battery grade nickel powder product.

FIG. 1 of the drawing depicts the structure of the nickel powder product produced in Test No. 6. The extended surface area of the powder is clearly shown. When the structure of the FIG. 1 product is compared to that of FIG. 2 which depicts a battery grade nickel powder produced by carbonyl decomposition it is seen that the latter powder particles are individually dense as compared to the particles of FIG. 1.

Powder produced in accordance with the invention will have a particle size of about 0.1 to about 3 micrometers, a free flow density of about 0.2 to about 0.5 grams per milliliter, a packed density of about 0.5 to about 1 grams. The powder is essentially pure nickel with no more than 3000 ppm oxygen, no more than 300 ppm sulfur and no more than 1000 ppm of metals such as chromium, cobalt, iron, copper, etc.

The results achieved using sodium formaldehyde sulfoxalate (rongalite) as a catalytic reductant in the pressurized hydrogen reduction of nickel sulfate solutions are unique and unpredictable. Thus, comparison tests using sodium borohydride, hydrazine, hydroxyl ammonium sulfate [$(NH_2OH)_2.H_2SO_4$], hydrazine sulfate ($NH_2NH_2.H_2SO_4$), hypophosphorous acid ($H_3PO_2$), oxalyl dihydrazide ($NH_2NHCOCONHNH$), sodium erythorbate ($NaC_6H_7O_6$) chromous sulfate ($CrSO_4$) and thiosemicarbazide ($NH_2CSNHNH_2$) yielded results which were unsatisfactory in one or more respects as compared to the results of the invention. Thus, pressurized hydrogen reduction using hydrazine sulfate, hydroxyl ammonium sulfate and oxalyl dihydrazide as catalyst was incomplete even using extended times of reduction. Thiosemicarbazide gave no reaction. Fine nickel powders resulted when hydrazine, sodium erythorbate and hypophosphorous acid were used but severe caking and plating of the autoclave occurred. Chromous sulfate yielded a fine nickel powder having a particle size less than 3 micrometers and an apparent density less than 0.8 gram/cc and a fast reduction rate but the product powder was high in chromium and sulfur and attempts to reduce the chromium content by reducing chromous sulfate addition, temperature and nickel concentration resulted in increasing the density and particle size of the product powder. Sodium borohydride gave nickel powders which were too coarse and too dense, in contrast to the different results achieved in the case of cobalt sulfate reduction with pressurized hydrogen and sodium borohydride in which the cobalt powder is fine and fluffy.

The actual results achieved using reductant catalysts outside the invention are presented in Table 4. The nickel sulfate solution was the same as that described in Example 1 and all tests were conducted using the same 2-liter autoclave with 2 stirrers, 400 rpm agitation during heating and 1000 rpm after temperature was reached, 600 psig total pressure, 135° C. with addition of 275 ml concentrated ammonia.

TABLE 4

Autoclave Hydrogen Reduction of Nickel From Nickel Sulfate Solution With Various Seeding Reagents

| Test No. | Reagents | Amount Added g. | Time, min | % Reduced | Apparent Density g/cc | Grain Size, u | Surface Area $M^2/g$ | S % |
|---|---|---|---|---|---|---|---|---|
| 1 | Hydrazine (64%) | 1.56 | 74 | 98.5 | 0.96 | 8 | 16.57 | 0.774 |
| 2 | Hydrazine Sulfate | 1 | 113 | Incomplete | — | — | — | — |
| 3 | Hydroxyl Ammonium Sulfate | 1 | 111 | Incomplete | — | — | — | — |
| 4 | Oxalyl Dihydrazide | | | | | | | |
| 5 | Thiosemicarbazide | 1 | 120 | No reaction | | | | |
| 6 | Sodium Erythorbate | 1 | 120 | 98.4 | 1.83 | 9 | 0.22 | 0.058 |
| 7 | Hypophosphorous Acid | 2 | 90 | 98.4 | 2.01 | 25 | 0.12 | 0.061 |
| 8 | Sodium Borohydride | 0.5 | 54 | 98.3 | 1.60 | 5 | 0.22 | 0.045 |
| 9 | Chromous Sulfate | 1.8 | 3 | 98.5 | 0.85 | 2 | 14.84 | 0.342 |

Nickel powder produced in accordance with the invention because of its fine particle size and extended surface area is electrochemically active and is useful in electrochemical applications such as battery electrodes, in the production of nickel salts by reaction with a mineral acid and in other applications in which its unique physical form may be utilized. Further examples include metal-filled plastics having high electrical conductivity. The process in accordance with the invention also offers the practical advantage of economy in nickel production since only a small amount of catalyst, e.g., rongalite, is required in proportion to nickel reduced.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. In the process for producing nickel powder by pressurized hydrogen reduction of an ammoniacal nickel sulfate solution at an elevated temperature in the presence of a catalytic agent, the improvement for producing nickel powder of extended surface area which comprises using as said catalytic agent a small amount of a compound from the group consisting of sodium formaldehyde sulfoxalate, formaldehyde acetamide, formaldehyde bisulfide, formaldehyde hydrosulfide, and formaldehyde oxime.

2. The process in accordance with claim 1 wherein said catalytic agent is sodium formaldehyde sulfoxalate.

3. The process in accordance with claim 1 in which said nickel sulfate solution contains about 30 to about 150 grams per liter of nickel, said catalytic agent is sodium formaldehyde sulfoxalate and said catalytic agent is used in the amount of about 0.05 mol percent to about 0.25 mol percent of said nickel.

* * * * *